US005493944A

United States Patent [19]

Felkins et al.

[11] Patent Number: 5,493,944

[45] Date of Patent: Feb. 27, 1996

[54] PNEUMATIC RANDOM VIBRATION GENERATOR

[75] Inventors: Charles F. Felkins, Berthoud; John C. Hess, Boulder; Robert A. Martin, Loveland, all of Colo.

[73] Assignee: Storage Technology Corporation, Louisville, Colo.

[21] Appl. No.: 299,451

[22] Filed: Sep. 1, 1994

[51] Int. Cl.[6] ..... F01L 21/00

[52] U.S. Cl. ..... 91/218; 91/234

[58] Field of Search ..... 60/369, 370; 91/218, 91/276, 232, 234; 92/129; 366/124; 73/665

[56] References Cited

U.S. PATENT DOCUMENTS

| | | | |
|---|---|---|---|
| 1,207,417 | 12/1916 | Kutschka | 60/370 |
| 3,144,708 | 8/1964 | Poorman | 91/232 |
| 3,894,586 | 7/1975 | Lyon | 91/276 |
| 3,895,561 | 7/1975 | Felderhof et al. | 91/234 |
| 4,129,388 | 12/1978 | McKee | 366/124 |
| 5,044,254 | 9/1991 | Miller et al. | 60/370 |

FOREIGN PATENT DOCUMENTS

| | | | |
|---|---|---|---|
| 2108451 | 5/1983 | United Kingdom | 91/218 |

*Primary Examiner*—F. Daniel Lopez
*Attorney, Agent, or Firm*—Sterne, Kessler, Goldstein & Fox

[57] ABSTRACT

A true random vibration generator for use in mechanical vibration generation includes a housing, a piston, and a programmer. The housing defines a cylinder closed at an impact end. The piston is slidably disposed in the cylinder and propelled by a pressurized gas. The programmer is freely moveable in the cylinder between the piston and the impact end of the cylinder. As the piston is propelled towards the impact end of the cylinder by the pressurized gas, the piston strikes the programmer causing the programmer to randomly bounce between the impact end of the cylinder and the piston. The bouncing continue until the programmer impacts the housing and the cylinder at substantially the same time. The piston is then propelled back its original position by the pressurized gas and the impact with the housing. The above described piston cycle is repeated and continues to impart vibration energy to the housing.

27 Claims, 2 Drawing Sheets

PNEUMATIC RANDOM VIBRATION GENERATOR

BACKGROUND OF THE INVENTION

1. Field of the Invention

The present invention relates generally to vibration generation for mechanically stressing a product, an example of which is environmental stress screening. More particularly, the present invention is directed to a vibration hammer for generating random vibration.

2. Related Art

Environmental stress screening is a process by which a product is stressed by environmental conditions in an attempt to transform latent defects into manifest defects. This process allows a manufacturer to uncover flaws in product quality before the product is shipped to a customer. One environmental stress screening test which has proven effective is vibration.

In the infancy of vibration testing, manufacturers relied on swept sinusoidal vibration excitation. In swept sinusoidal testing, a single frequency sinusoidal excitation is swept through a frequency range of interest. A major disadvantage of these swept sinusoidal excitation systems is that the excitation frequency coincides with the natural resonance frequency of the unit-under-test for only a short period of time. Thus, there is insufficient vibration time at critical frequencies for latent defects to become manifest defects.

Recently, electrodynamic shakers have been used to generate random vibration excitation. Electrodynamic shakers consist of electrically-driven armatures, power amplifiers, and associated control equipment. Although electrodynamic shakers can generate random vibration, the cost is prohibitively expensive. This high cost has driven the environmental stress screening community to adopt pneumatic hammers as the preferred vibration source.

The conventional pneumatic hammer includes a housing and a piston. The piston is free floating within a cylinder of the housing and is pneumatically driven to reciprocate in the cylinder. The reciprocating motion along with collisions between the piston and an end of the cylinder generate the desired vibrations. A programmer (made from a polymer or other resilient material) may be attached to the head of the piston or the end of the cylinder to cushion the collisions between housing and piston.

Pneumatic hammers generally operate at a fixed frequency. They rely on the harmonic effects of the piston impacts to distribute excitation energy over a broad range of frequencies. A major disadvantage of pneumatic hammers is the high amplitude acceleration peaks at the fixed frequency of the hammer. If one or more of the natural frequencies of the unit-under-test is coincident with these acceleration peaks, then the unit may be excessively vibrated. Excessive vibration can overstress and damage the unit-under-test.

Several attempts have been made to randomize the operating frequency of pneumatic hammers. One method to randomize pneumatic hammers is to randomly regulate the pressurized gas used to drive the piston. This causes the hammer to excite the vibration table at varying intervals and with varying force which produces pseudo-random excitation. However, a true random vibration is not achieved.

Another method varies the stroke of the piston. Varying the stroke of the piston varies the interval and the force of the piston impacting the housing. However, this method produces only a limited pseudo-random vibration.

Thus, conventional methods have increased the randomness of pneumatic hammers, but have failed to produce true random excitation. Furthermore, the apparatus required to produce these pseudo-random effects is complex and often expensive to implement and manufacture.

SUMMARY OF THE INVENTION

The present invention is a vibration generator of the pneumatic hammer type for generating true random vibration. The vibration generator includes a housing, a piston, and a programmer. The housing defines a cylinder closed at an impact end. The piston is slidably disposed in the cylinder and propelled by a pressurized gas. The programmer is freely moveable in the cylinder between the piston and the impact end of the cylinder. As the piston is propelled towards the impact end of the cylinder by the pressurized gas, the piston strikes the programmer. This collision causes the programmer to strike the impact end of the cylinder imparting vibration energy to the housing. The programmer rebounds and travels back towards the piston. The programmer again strikes the piston, propelling the programmer back towards the impact end of the cylinder, again imparting vibration energy to the housing. This process continues until the programmer strikes the housing and the piston at substantially the same time, again transferring vibration energy to the housing. In other words, the programmer is pinned by the piston against the impact end of the cylinder. The piston is then propelled back to its original position by the impact and the pressurized gas. The process then repeats. The random motion of the freely moving programmer imparts true random vibration to the housing.

The programmer is substantially cylindrical with a hole or holes through its longitudinal axis to allow gas to flow freely there through. These holes prevent restricted programmer motion due to pressure build-up. The piston is substantially cylindrical, with thrust ports to direct gas to the rear of the piston and a reverse-thrust port to direct gas to the head of the piston. The housing has an inlet port and multiple outlet ports.

The present invention creates true random vibration at less cost than electrodynamic shakers and creates vibration that is truly random as opposed to conventional pneumatic hammers. In addition, the present invention does not utilize the complex means necessary to vary pressure or vary piston stroke. The present invention offers a simple, low-cost solution for generating true random vibration for vibration applications.

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

The preferred embodiment of the invention is discussed in detail below. While specific part numbers and configurations are discussed, it should be understood that this is done for illustration purposes only. A person skilled in the relevant art will recognize that other components and configurations may be used without parting from the spirit and scope of the invention.

The preferred embodiment of the invention is now described with reference to the figures where like reference numbers indicate like elements. In addition, the left-most digit of each reference number indicates the figure n which the number is first used.

Figure 1:
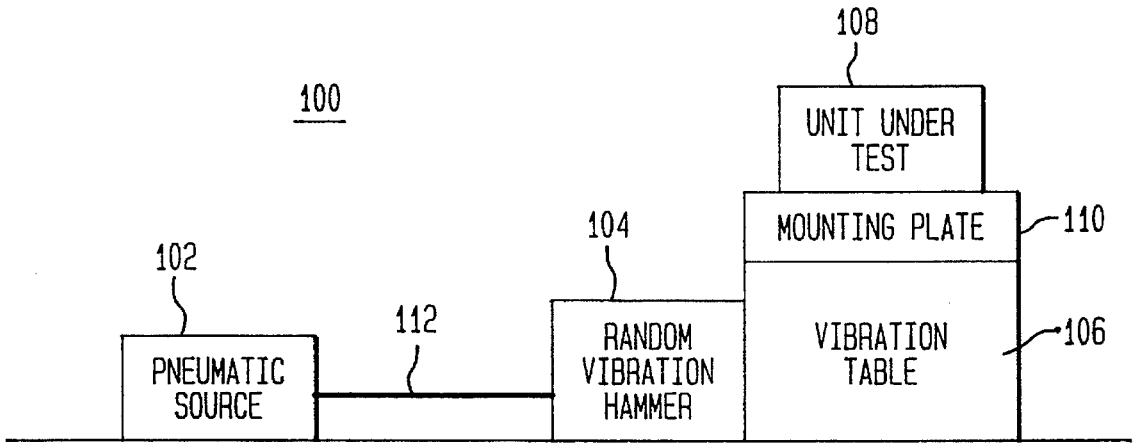
FIG. 1 illustrates a vibration system for randomly vibrating a unit-under-test in accordance with the present invention.

FIG. 1 shows a vibration system 100 for randomly vibrating a unit-under-test 108. The vibration system comprises an pneumatic source 102, a random vibration hammer 104, a vibration table 106, and a mounting plate 110. Unit-under-test 108 is mounted to mounting plate 110. Mounting plate 110 is attached to vibration table 106. Pneumatic source 102 provides pressurized gas 112 to random vibration hammer 104. Random vibration hammer 104 randomly vibrates vibration table 106. Vibration table 106 then propagates this vibration to mounting plate 110 and unit-under-test 108.

Figure 2:
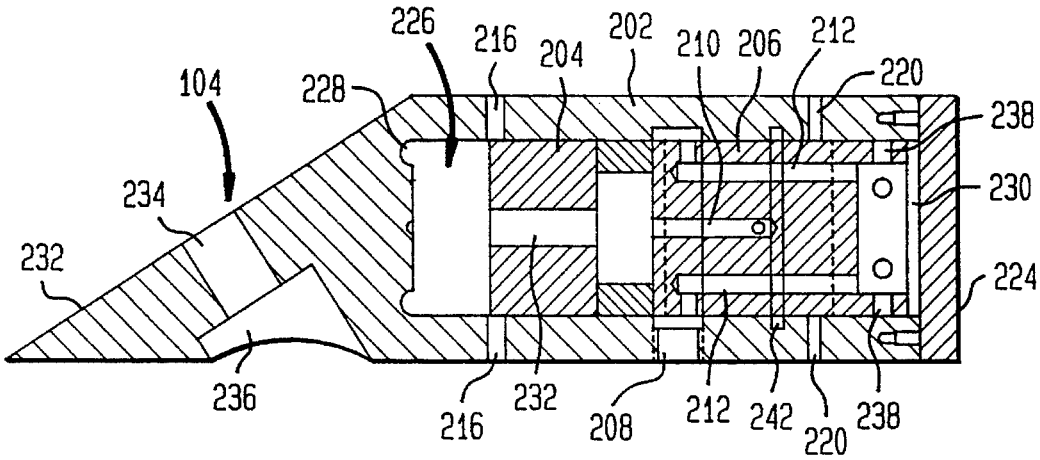
FIG. 2 illustrates a vibration hammer with a freely moving programmer in accordance with the present invention.

FIG. 2 shows a preferred embodiment of random vibration hammer 104, hereinafter vibration hammer 104. Vibration hammer 104 includes a housing 202, a programmer 204, a piston 206, and a cap 224.

Vibration hammer 104 is mounted to vibration table 106 via a mounting hole 234. A mounting surface 232 is mounted flush with vibration table 106. A bolt through mounting hole 234 attaches vibration hammer to vibration table 106. The head of the bolt rests in a counter sink 236.

A cylinder 226 is bored into housing 202. Cylinder 226 has an impact end 228 and a capped end 230. Programmer 204 and piston 206 are disposed in cylinder 226. Cap 224 encloses capped end 230 of cylinder 226.

A debris collection ring 242 is a recessed ring in cylinder 226. Debris collection ring 242 collects any debris, such as metal filings, present between cylinder 226 and the outer wall of piston 206.

Piston 206 is propelled towards impact end 228 of cylinder 226 by pressurized gas 112 from pneumatic source 102. Piston 206 strikes programmer 204 causing programmer 204 to strike impact end 228. This impact imparts energy to housing 202. Programmer 204 rebounds and travels back towards piston 206. Programmer 204 again strikes piston 206 propelling programmer 204 towards impact end 228. This impact again imparts energy to housing 202. When programmer 204 impacts both housing 202 and piston 206 at substantially the same time, piston 206 is propelled back to capped end 230 by pressurized gas 112 and by the rebound force from hitting impact end 228. The above described piston cycle is repeated and continues to impart energy to housing 202.

In a preferred embodiment, programmer 204 is located in cylinder 226 between piston 206 and impact end 228 of cylinder 226. Programmer 204 is freely movable in cylinder 226, i.e., programmer 204 is not attached to either housing 202 or piston 206. Programmer 204 is substantially cylindrical with a hole 232 to allow gas to flow freely there through. In a preferred embodiment, programmer 204 is constructed from a hard but resilient material, such as an impact resistant polymer (e.g. a nylon composite or glass-filled delrin).

Piston 206 is substantially cylindrical and has a reverse-thrust port 210, multiple thrust ports 212, and multiple piston exhaust holes 238. Reverse-thrust port 210 directs gas to the impact end, the end nearest programmer 204, of the piston. Thrust ports 212 direct gas to the rear end, the end nearest cap 224, of the piston. Piston exhaust holes 238 allow gas to escape from cylinder 226 when piston 206 is moving toward capped end 230.

In a preferred embodiment, housing 202 is constructed from a hardened metal such as ductile cast iron. Cylinder 226 is bored into housing 202. Housing 202 has an inlet port 208, and multiple outlet ports 216 and 220. Inlet port 208 is a recessed ring in cylinder 226. This configuration permits pressurized gas 112 to enter reverse-thrust port 210 or thrust ports 212 regardless of the rotation of piston 206 in cylinder 226. Outlet ports 216 are located near impact end 228 of cylinder 226. Outlet ports 220 are located near capped end 230 of cylinder 226.

Figure 3:
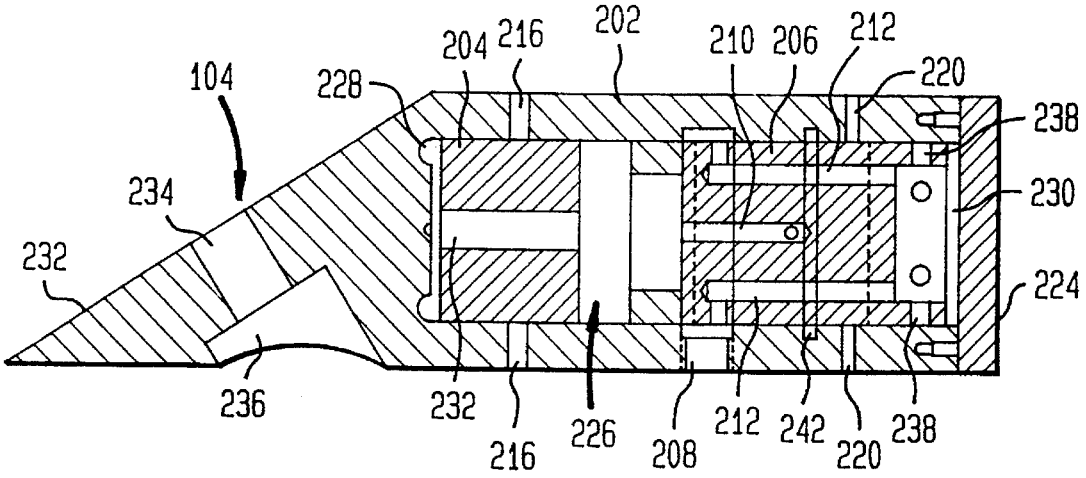
FIG. 3 is the vibration hammer of FIG. 2 illustrating the programmer in a position adjacent to the impact end of the cylinder.
Figure 4:
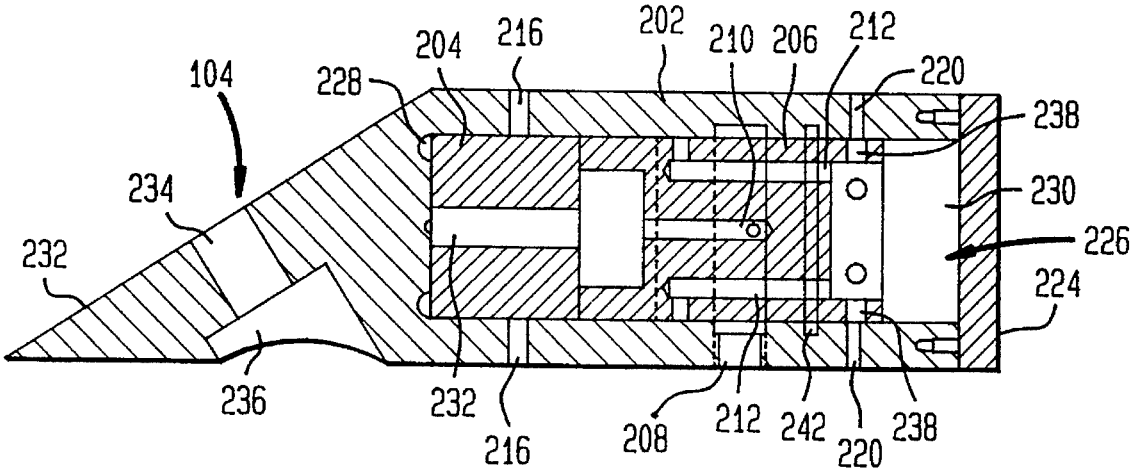
FIG. 4 is the vibration hammer of FIG. 2 illustrating the programmer and the piston in a position adjacent to the impact end of the cylinder.

For illustration purposes FIGS. 2–4 show two outlet ports 216, two outlet ports 220, two piston exhaust holes 238, and two thrust ports 212. In a preferred embodiment, there are two outlet ports 216, four outlet ports 220, four piston exhaust holes 238, and two thrust ports 212. It would be apparent to a person skilled in the relevant art that other combinations of outlet ports 216 and 220, piston exhaust holes 238 and thrust ports 212 would achieve the desired venting and pressurizing of cylinder 226.

FIGS. 2–4 illustrate the operation of random vibration hammer 104. In an initial position, shown in FIG. 2, piston 206 is located adjacent to cap 224. In this position, the openings to thrust ports 212 are aligned with inlet port 208. Pressurized gas 112 from pneumatic source 102 enters housing 202 through inlet port 208. Pressurized gas 112 is directed to the rear end, the end nearest cap 224, of piston 206 via thrust ports 212. Pressurized gas 112 then fills the volume between piston 206 and capped end 230 of cylinder 226 to propel piston 206 towards impact end 228 of cylinder 226. As piston 206 moves toward impact end 228, gas escapes out of outlet ports 216, providing minimal resistance to the piston's forward motion.

Piston 206 impacts programmer 204 and propels programmer 204 towards impact end 228, as shown in FIG. 3. Programmer 204 impacts housing 202 imparting an impulsive force. Programmer 204 then rebounds and moves towards piston 206. As piston 206 continues its motion toward impact end 228 of cylinder 226, it will make multiple impacts with programmer 204. Programmer 204 is bounced back and forth against impact end 228 and piston 206. This process continues until programmer 204 strikes piston 206 and housing 202 at substantially the same time, as shown in FIG. 4.

When piston 206 is in the position illustrated in FIG. 4, piston exhaust holes 238 align with outlet ports 220, reducing the pressure at capped end 230. Simultaneously, reverse-thrust port 210 of piston 206 is aligned with inlet port 208. This allows pressurized gas 212 to enter reverse-thrust port 210 through inlet port 208. Reverse-thrust port 210 directs pressurized gas 112 towards the impact end of piston 206 to propel piston 206 back toward capped end 230. As piston 206 moves towards capped end 230, outlet ports 216 are closed, allowing impact end 228 of cylinder 226 to pressurize. Programmer 204 is then free to move in the gap between impact end 228 and piston 206.

As piston 206 moves toward cap 224, as shown in FIG. 2, pressurized gas enters thrust ports 212 through inlet port 208. Piston 206 is again propelled toward programmer 204 and the above described piston cycle is repeated.

Impact energy is randomized by vibration hammer 104 in two ways. First, since programmer 204 moves freely in cylinder 226 between impact end 228 and piston 206, piston 206 does not strike the programmer at the same position in the cylinder each piston cycle. Thus, piston 206 imparts different momentum characteristics to programmer 204 each time they impact. This results in random amplitude modulation of the impulsive force between piston 206 and cylinder 226, creating additional frequencies. Second, programmer 204 repetitively impacts housing 202 as piston 206 is propelled toward impact end 228. Since the gap between piston 206 and impact end 228 is narrowed as the piston is propelled toward impact end 228, the time interval between impacts is not periodic within a piston cycle. Thus, the energy imparted on housing 202 is randomized. This randomized energy creates true random vibration which is imparted to vibration table 106, mounting plate 110, and unit-under-test 108.

While the invention has been particularly shown and described with reference to several preferred embodiments thereof, it will be understood by those skilled in the art that various changes in form and details may be made therein without departing from the spirit and scope of the invention as defined in the appended claims.

What is claimed is:

1. An apparatus for generating random vibration, comprising:

a housing defining a bore closed at a first end;

a piston slidably disposed in said bore;

a programmer disposed in said bore between said piston and said first end of said bore, said programmer being freely movable between said piston and said first end; and means for propelling said piston toward said first end of said bore causing said piston to strike said programmer and said programmer to strike said housing at said first end of said bore.

2. The apparatus of claim 1, wherein said bore, said piston and said programmer are substantially cylindrical.

3. The apparatus of claim 2, wherein a second end of said bore is closed by a cap.

4. The apparatus of claim 2, wherein said means for propelling comprises:

pneumatic means for propelling said piston toward said first end of said bore.

5. The apparatus of claim 4, wherein said housing is closed at a second end and said pneumatic means comprises:

a thrust port in said piston, said thrust port having a first opening on a side wall of said piston and a second opening at a rear end of said piston;

a reverse-thrust port in said piston, said reverse-thrust port having a first opening on a side wall of said piston and a second opening at a head end of said piston:

an inlet port in said housing, said inlet port being configured to receive said pressurized gas from an external source and to provide said pressurized gas to said first opening of said thrust port of said piston when said piston is adjacent to said second end of said bore, and provide said pressurized gas to said first opening of said reverse-thrust port of said piston when said piston is adjacent to said first end of said bore;

a first outlet port in said housing near said first end of said bore, said first outlet port configured to allow gas to escape as said piston moves toward said first end of said bore; and a second outlet port in said housing near said second end of said bore, said second outlet port configured to allow gas to escape as said piston moves toward said second end of said bore.

6. The apparatus of claim 2, wherein said programmer is made from an impact resistant material.

7. The apparatus of claim 6, wherein said impact resistant material is a polymer.

8. An apparatus for generating random vibration, comprising:

a housing defining a bore closed at a first end;

piston means for reciprocating within said bore;

programmer means, disposed in said bore between said piston means and said first end of said bore, for transmitting randomly applied impulsive energy from said piston means to said housing, said programmer means being freely movable between said piston means and said first end; and means for propelling said piston means towards said programmer means.

9. The apparatus of claim 8, wherein said bore, said piston means and said programmer means are substantially cylindrical.

10. The apparatus of claim 9, wherein a second end of said bore is closed by a capping means.

11. The apparatus of claim 9, wherein means for propelling comprises:

pneumatic means for propelling said piston toward said first end of said bore.

12. The apparatus of claim 11, wherein said housing is closed at a second end and said pneumatic means comprises:

thrust port means for directing gas to the rear end of said piston;

reverse-thrust port means for directing gas to a head end of said piston;

inlet port means for receiving said pressurized gas from an external source and providing said pressurized gas to said thrust port means when said piston is adjacent to said second end of said bore, and provide said pressurized gas to said reverse-thrust port means when said piston is adjacent to said first end of said bore;

first outlet port means for allowing gas to escape from said bore as said piston moves toward said first end of said bore; and second outlet port means for allowing gas to escape from said bore as said piston moves toward said second end of said bore.

13. The apparatus of claim 9, wherein said programmer is made from an impact resistant material.

14. The apparatus of claim 13, wherein said impact resistant material is a polymer.

15. A vibration table for randomly vibrating a component, comprising:

a mounting plate configured to have the component mounted thereon;

means for generating vibration and imparting said vibration to said mounting plate, said means for generating vibration comprising:

a housing defining a bore closed at a first end, a piston slidably disposed in said bore, a programmer disposed in said bore between said piston and said first end of said bore, said programmer being freely movable between said piston and said first end, and means for propelling said piston toward said first end of said bore causing said piston to strike said programmer and said programmer to strike said housing at said first end of said bore.

16. The apparatus of claim 15, wherein said bore, said piston and said programmer are substantially cylindrical.

17. The apparatus of claim 16, wherein a second end of said bore is closed by a cap.

18. The apparatus of claim 16, wherein said means for propelling comprises:

pneumatic means for propelling said piston toward said first end of said bore.

19. The apparatus of claim 18, wherein said housing is closed at a second end and said pneumatic means comprises:

a thrust port in said piston, said thrust port having a first opening on a side wall of said piston and a second opening at a rear end of said piston;

a reverse-thrust port in said piston, said reverse-thrust port having a first opening on a side wall of said piston and a second opening at a head end of said piston;

an inlet port in said housing, said inlet port being configured to receive said pressurized gas from an external source and to provide said pressurized gas to said first opening of said thrust port of said piston when said piston is adjacent to said second end of said bore, and provide said pressurized gas to said first opening of said reverse-thrust port of said piston when said piston is adjacent to said first end of said bore;

a first outlet port in said housing near said first end of said bore, said first outlet port configured to allow gas to escape as said piston moves toward said first end of said bore; and a second outlet port in said housing near said second end of said bore, said second outlet port configured to allow gas to escape as said piston moves toward said second end of said bore.

20. The apparatus of claim 16, wherein said programmer is made from an impact resistant material.

21. The apparatus of claim 20, wherein said impact resistant material is a polymer.

22. A random vibration generator for use in mechanical vibration applications, comprising:

a housing defining a cylinder closed at a first end;

a piston slidably disposed in said cylinder;

a programmer disposed in said cylinder between said piston and said first end of said cylinder, said programmer being freely movable between said piston and said first end; and means for propelling said piston toward said first end of said cylinder causing said piston to strike said programmer and said programmer to strike said housing at said first end of said cylinder.

23. The apparatus of claim 22, wherein a second end of said cylinder is closed by a cap.

24. The apparatus of claim 22, wherein said means for propelling comprises:

pneumatic means for propelling said piston toward said first end of said cylinder.

25. The apparatus of claim 24, wherein said housing is closed at a second end and said pneumatic means comprises:

a thrust port in said piston, said thrust port having a first opening on a side wall of said piston and a second opening at a rear end of said piston;

a reverse-thrust port in said piston, said reverse-thrust port having a first opening on a side wall of said piston and a second opening at a head end of said piston;

an inlet port in said housing, said inlet port being configured to receive said pressurized gas from an external source and to provide said pressurized gas to said first opening of said thrust port of said piston when said piston is adjacent to said second end of said bore, and provide said pressurized gas to said first opening of said reverse-thrust port of said piston when said piston is adjacent to said first end of said bore;

a first outlet port in said housing near said first end of said cylinder, said first outlet port configured to allow gas to escape as said piston moves toward said first end of said cylinder; and a second outlet port in said housing near said second end of said cylinder, said second outlet port configured to allow gas to escape as said piston moves toward said second end of said cylinder.

26. The apparatus of claim 22, wherein said programmer is made from an impact resistant material.

27. The apparatus of claim 26, wherein said impact resistant material is a polymer.

* * * * *